US007196270B2

(12) United States Patent
Perego et al.

(10) Patent No.: US 7,196,270 B2
(45) **Date of Patent: *Mar. 27, 2007**

(54) CABLE WITH RECYCLABLE COVERING LAYER

(75) Inventors: Gabriele Perego, Milan (IT); Cristiana Scelza, Milan (IT); Gaia Dell'Anna, Milan (IT); Sergio Belli, Milan (IT)

(73) Assignee: Prysmian Cavi E Sistemi Energia S.r.L., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 10/542,572

(22) PCT Filed: Jan. 15, 2004

(86) PCT No.: PCT/EP2004/000242

§ 371 (c)(1),
(2), (4) Date: Jul. 19, 2005

(87) PCT Pub. No.: WO2004/066318

PCT Pub. Date: Aug. 5, 2004

(65) Prior Publication Data

US 2006/0124341 A1 Jun. 15, 2006

(30) Foreign Application Priority Data

Jan. 20, 2003 (WO) ..... PCT/EP03/00482

(51) Int. Cl.
*H01B 3/44* (2006.01)

(52) U.S. Cl. ..... 174/110 R; 174/36

(58) Field of Classification Search ..... 174/110 R–110 FC, 113 R, 120 R, 120 C, 120 AR
See application file for complete search history.

(56) References Cited

U.S. PATENT DOCUMENTS

| | | | | |
|---|---|---|---|---|
| 4,543,207 | A | 9/1985 | Sato et al. | |
| 4,621,302 | A * | 11/1986 | Sato et al. | 631/315 |
| 4,857,673 | A * | 8/1989 | Wilkus et al. | 174/110 PM |
| 5,017,733 | A * | 5/1991 | Sato et al. | 585/6.3 |
| 5,192,463 | A * | 3/1993 | Berger et al. | 252/570 |
| 5,446,228 | A * | 8/1995 | Commandeur et al. | 585/613 |
| 5,545,355 | A * | 8/1996 | Commandeur et al. | 252/570 |
| 5,601,755 | A * | 2/1997 | Commandeur et al. | 252/570 |
| 6,001,933 | A * | 12/1999 | Tsuruoka et al. | 525/232 |

FOREIGN PATENT DOCUMENTS

| | | |
|---|---|---|
| EP | 0 987 718 | 3/2000 |
| IT | WO 02/03398 | * 1/1992 |
| WO | WO 98/32137 | 7/1998 |
| WO | WO 98/52197 | 11/1998 |

(Continued)

*Primary Examiner*—William H. Mayo, III
(74) *Attorney, Agent, or Firm*—Finnegan, Henderson, Farabow, Garrett & Dunner, L.L.P.

(57) ABSTRACT

A cable having at least one electrical conductor and at least one extruded covering layer based on a thermoplastic polymer material in admixture with a dielectric liquid. The thermoplastic polymer material is selected from: (a) at least one propylene homopolymer or at least one copolymer of propylene with at least one olefin comonomer; (b) a mechanical mixture of at least one propylene homopolymer or copolymer (a) and (c) at least one elastomeric copolymer or ethylene with at least one aliphatic α-olefin, and optionally a polyene.

48 Claims, 1 Drawing Sheet

FOREIGN PATENT DOCUMENTS

| | | |
|---|---|---|
| WO | WO 99/13477 | 3/1999 |
| WO | WO 00/41187 | 7/2000 |
| WO | WO 01/37289 | 5/2001 |
| WO | WO 02/03398 | 1/2002 |
| WO | WO 02/27731 | 4/2002 |
| WO | WO 02/47092 | 6/2002 |

* cited by examiner

CABLE WITH RECYCLABLE COVERING LAYER

CROSS REFERENCE TO RELATED APPLICATIONS

This application is a national phase application based on PCT/EP2004/000242, filed Jan. 15, 2004, and claims the priority of PCT/EP03/00482, filed Jan. 20, 2003, the content of both of which is incorporated herein by reference.

BACKGROUND OF THE INVENTION

1. Field of the Invention

The present invention relates to a cable with recyclable covering layer. In particular, the invention relates to a cable for transporting or distributing medium or high voltage electric energy, wherein an extruded covering layer based on a thermoplastic polymer material in admixture with a dielectric liquid with good mechanical and electrical properties is present, enabling, in particular, the use of high operating temperatures and the transportation of high power energy.

Said cable may be used for both direct current (DC) or alternating current (AC) transmission or distribution.

2. Description of the Related Art

The requirement for products of high environmental compatibility, composed of materials which, in addition to not being harmful to the environment during production or utilization, may be easily recycled at the end of their life, is now fully accepted in the field of electrical and telecommunications cables.

However the use of materials compatible with the environment is conditioned by the need to limit costs while, for the more common uses, providing a performance equal to or better than that of conventional materials.

In the case of cables for transporting medium and high voltage energy, the various coverings surrounding the conductor commonly consist of polyolefin-based crosslinked polymer, in particular crosslinked polyethylene (XLPE), or elastomeric ethylene/propylene (EPR) or ethylene/propylene/diene (EPDM) copolymers, also crosslinked. The crosslinking, effected after the step of extrusion of the polymeric material onto the conductor, gives the material satisfactory mechanical and electrical properties even under high temperatures both during continuous use and with current overload.

It is well known however that crosslinked materials cannot be recycled, so that manufacturing wastes and the covering material of cables which have reached the end of their life may be disposed of only by incineration.

Electric cables are also known having their insulation consisting of a multi-layer wrapping of a paper or paper/polypropylene laminate impregnated with a large quantity of a dielectric liquid (commonly known as mass impregnated cables or also oil-filled cables). By completely filling the spaces present in the multi-layer wrapping, the dielectric liquid prevents partial discharges arising with consequent break down of the electrical insulation. As dielectric liquids products are commonly used such as mineral oils, polybutenes, alkylbenzenes and the like (see, for example, U.S. Pat. Nos. 4,543,207, 4,621,302, EP 987,718, WO 98/32137).

It is however well known that mass impregnated cables have numerous drawbacks compared with extruded insulation cables, so that their use is currently restricted to specific fields of application, in particular to the construction of high and very high voltage direct current transmission lines, both for terrestrial and in particular for underwater installations.

In this respect, the production of mass impregnated cables is particularly complex and costly, both for the high cost of the laminates and for the difficulties encountered during the steps of wrapping the laminate and then of impregnating it with the dielectric liquid. In particular, the dielectric liquid used must have low viscosity under low temperatures to allow rapid and uniform impregnation, while at the same time it must have a low tendency to migrate during installation and operation of the cable to prevent liquid loss from the cable ends or from accidentally breaks on the cable. In addition, mass impregnated cables cannot be recycled and their use is limited to an operating temperature of less than 90° C.

Within non-crosslinked polymeric materials, it is known to use high density polyethylene (HDPE) for covering high voltage cables. HDPE has however the drawback of a lower temperature resistance than XLPE, both to current overload and during operation.

Thermoplastic low density polyethylene (LDPE) insulating coverings are also used in medium and high voltage cables: again in this case, these coverings are limited by a too low operating temperature (about 70° C.).

International Patent Application WO 99/13477 discloses an insulating material consisting of a thermoplastic polymer forming a continuous phase which incorporates a liquid or easily meltable dielectric forming a mobile interpenetrating phase within the solid polymer structure. The weight ratio of thermoplastic polymer to dielectric is between 95:5 and 25:75. The insulating material may be produced by mixing the two components while hot either batchwise or continuously (for example, by means of an extruder). The resultant mixture is then granulated and used as insulating material for producing a high voltage electric cable by extrusion onto a conductor. The material may be used either in thermoplastic or crosslinked form. As thermoplastic polymers are indicated: polyolefins, polyacetates, cellulose polymers, polyesters, polyketones, polyacrylates, polyamides and polyamines. The use of polymers of low crystallinity is particularly suggested. The dielectric is preferably a synthetic or mineral oil of low or high viscosity, in particular a polyisobutene, naphthene, polyaromatic, α-olefin or silicone oil.

International Patent Application WO 02/03398 in the name of the Applicant, discloses a cable comprising at least one electrical conductor and at least one extruded covering layer based on thermoplastic polymer material in admixture with a dielectric liquid, wherein said thermoplastic material comprises a propylene homopolymer or a copolymer of propylene with at least one olefin comonomer selected from ethylene and an α-olefin other than propylene, said homopolymer or copolymer having a melting point greater than or equal to 140° C. and a melting enthalpy of from 30 J/g to 100 J/g. Said dielectric liquid comprises at least one alkylaryl hydrocarbon having at least two non-condensed aromatic rings and a ratio of number of aryl carbon atoms to total number of carbon atoms greater than or equal to 0.6, preferably greater than or equal to 0.7.

International Patent Application WO 02/27731 in the name of the Applicant, discloses a cable comprising at least one electrical conductor and at least one extruded covering layer based on thermoplastic polymer material in admixture with a dielectric liquid, wherein said thermoplastic material comprises a propylene homopolymer or a copolymer of propylene with at least one olefin comonomer selected from ethylene and an α-olefin other than propylene, said homopolymer or copolymer having a melting point greater than or equal to 140° C. and a melting enthalpy of from 30

J/g to 100 J/g. Said dielectric liquid comprises at least one diphenyl ether, non-substituted or substituted with at least one linear or branched, aliphatic, aromatic or mixed aliphatic and aromatic $C_1$–$C_{30}$ hydrocarbon radical.

However, the prior art above cited presents some drawbacks.

As a matter of fact, Applicant noticed that the addition of a dielectric liquid to a polymer material should both determine a significant increase in its electrical properties (in particular, its dielectric strength), without impairing its thermomechanical characteristics and without resulting in exudation of the dielectric liquid from the polymer material. In particular, the resultant cable should give substantially constant mechanical and electrical performances with time and hence high reliability, even at high operating temperatures (at least 90° C. and beyond, in particular at operating temperature up to 110° C. for continuous use and up to 140° C. in the case of current overload). In particular, Applicant noticed that the presence of two phases, e.g. a continuous phase of a thermoplastic material and an additional phase incorporated therein of a dielectric liquid, with the consequent microscopically non homogeneous dispersion of said dielectric liquid onto said thermoplastic material, does not allow to obtain all the above reported characteristics.

SUMMARY OF THE INVENTION

The Applicant has now found that it possible to overcome said drawbacks by using, as recyclable polymer base material, at least one thermoplastic propylene homopolymer or copolymer or a mechanical mixture of said at least one thermoplastic propylene homopolymer or copolymer with at least one elastomeric copolymer of ethylene with at least one aliphatic α-olefin, and optionally a polyene, mixed with at least one dielectric liquid as hereinafter defined. The resultant composition possesses suitable flexibility, excellent thermomechanical characteristics and high electrical performance, such as to make it particularly suitable for forming at least one covering layer, and in particular an electrical insulating layer, of a medium or high voltage cable of high operating temperature, of at least 90° C. and beyond, in particular at operating temperature up to 110° C. for continuous use and up to 140° C. in the case of current overload. The dielectric liquid suitable for implementing the invention has high compatibility with the polymer base material and high efficiency in the sense of improving electrical performance, consequently allowing the use of small quantities (e.g. quantities lower than the saturation concentration of the dielectric liquid in the polymer base material) of said dielectric liquid such as not to impair the thermomechanical characteristics of the insulating layer and to avoid the exudation of said dielectric liquid from the polymer base material.

High compatibility between the dielectric liquid and the polymer base material allows to obtain a microscopically homogeneous dispersion of the dielectric liquid in the polymer base material. Moreover, the dielectric liquid suitable for forming the cable covering layer of the present invention comprises a small quantity of polar compounds, in order to avoid a significant increasing of the dielectric losses. It has to be noticed also that the use of a dielectric liquid with a relatively low melting point or low pour point (e.g. a melting point or a pour point not higher than 80° C.) does not give rise to manufacturing problems both during the mixing with the polymer material and during the production of the cable. As a matter of fact, the low melting point allows to an easier handling of the dielectric liquid which may be easily melted without the need of additional and complex manufacturing steps (e.g. a melting step of the dielectric liquid) and/or apparatuses. Moreover, Applicant noticed also that, when dielectric liquid is aromatic, high compatibility with the polymer base material may be achieved even in the presence of dielectric liquid with a low ratio of number of aromatic carbon atoms to total number of carbon atoms (e.g. ratio lower than 0.6).

The Applicant has also noticed that the addition of said dielectric liquid reduces or even eliminates the optical phenomena commonly known as "stress whitening" thanks to the fact that said dielectric liquid is microscopically homogeneously dispersed in the polymer material.

According to a first aspect, the present invention relates to a cable comprising at least one electrical conductor and at least one extruded covering layer based on a thermoplastic polymer material in admixture with a dielectric liquid, wherein:

said thermoplastic polymer material is selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of from 20 J/g to 100 J/g;

(b) a mechanical mixture comprising at least one propylene homopolymer or copolymer (a) and (c) at least one elastomeric copolymer of ethylene with at least one aliphatic α-olefin, and optionally a polyene;

the concentration by weight of said dielectric liquid in said thermoplastic polymer material is lower than the saturation concentration of said dielectric liquid in said thermoplastic polymer material;

said dielectric liquid has the following characteristics:

an amount of polar compounds lower than or equal to 2.5% by weight with respect to the total weight of the dielectric liquid;

a melting point or a pour point lower than 80° C.;

a ratio of number of aromatic carbon atoms with respect to the total number of carbon atoms lower than 0.6, when the dielectric liquid is aromatic.

In the present description and in the subsequent claims, the term "conductor" means a conducting element as such, of elongated shape and preferably of a metallic material, or a conducting element coated with a semiconducting layer.

The saturation concentration of the dielectric liquid in the thermoplastic polymer material may be determined by a liquid absorption method on Dumbell samples: further details regarding said method will be described in the examples given hereinbelow.

The amount of polar compounds of the dielectric liquid may be determined according to ASTM standard D2007-02.

The melting point may be determined by known techniques such as, for example, by Differential Scanning Calorimetry (DSC) analysis.

The pour point may be determined according to ASTM standard D97-02.

The ratio of number of aromatic carbon atoms with respect to the total number of carbon atoms may be determined according to ASTM standard D3238-95(2000)e1.

According to a first embodiment, the extruded covering layer based on said thermoplastic polymer material in admixture with said dielectric liquid is an electrically insulating layer.

According to a further embodiment, the extruded covering layer based on said thermoplastic polymer material in admixture with said dielectric liquid is a semiconductive layer.

According to one preferred embodiment, the propylene homopolymer or copolymer (a) which may be used in the present invention has a melting point of from 140° C. to 170° C.

Preferably, the propylene homopolymer or copolymer (a) has a melting enthalpy of from 30 J/g to 85 J/g.

Said melting enthalpy ($\Delta H_m$) may be determined by Differential Scanning Calorimetry (DSC) analysis.

Preferably, the propylene homopolymer or copolymer (a) has a flexural modulus, measured according to ASTM standard D790-00, at room temperature, of from 30 MPa to 1400 MPa, and more preferably from 60 MPa to 1000 MPa.

Preferably, the propylene homopolymer or copolymer (a) has a melt flow index (MFI), measured at 230° C. with a load of 21.6 N according to ASTM standard D1238-00, of from 0.05 dg/min to 10.0 dg/min, more preferably from 0.4 dg/min to 5.0 dg/min.

If a copolymer of propylene with at least one olefin comonomer (a) is used, this latter is preferably present in a quantity of less than or equal to 15 mol %, and more preferably of less than or equal to 10 mol %. The olefin comonomer is, in particular, ethylene or an α-olefin of formula $CH_2{=}CH{-}R$, where R is a linear or branched $C_2$–$C_{10}$ alkyl, selected, for example, from: 1-butene, 1-pentene, 4-methyl-1-pentene, 1-hexene, 1-octene, 1-decene, 1-dodecene, or mixtures thereof. Propylene/ethylene copolymers are particularly preferred.

Preferably, said propylene homopolymer or copolymer (a) is selected from:

($a_1$) a propylene homopolymer or a copolymer of propylene with at least one olefin comonomer selected from ethylene and an α-olefin other than propylene, having a flexural modulus generally of from 30 MPa to 900 MPa, and preferably of from 50 MPa to 400 MPa;

($a_2$) a heterophase copolymer comprising a thermoplastic phase based on propylene and an elastomeric phase based on ethylene copolymerized with an α-olefin, preferably with propylene, in which the elastomeric phase is preferably present in a quantity of at least 45 wt % with respect to the total weight of the heterophase copolymer.

Particularly preferred of said class ($a_1$) is a propylene homopolymer or a copolymer of propylene with at least one olefin comonomer selected from ethylene and an α-olefin other than propylene, said homopolymer or copolymer having:

a melting point of from 140° C. to 170° C.;

a melting enthalpy of from 30 J/g to 80 J/g;

a fraction soluble in boiling diethyl ether in an amount of less than or equal to 12 wt %, preferably from 1 wt % to 10 wt %, having a melting enthalpy of less than or equal to 4 J/g, preferably less than or equal to 2 J/g;

a fraction soluble in boiling n-heptane in an amount of from 15 wt % to 60 wt %, preferably from 20 wt % to 50 wt %, having a melting enthalpy of from 10 J/g to 40 J/g, preferably from 15 J/g to 30 J/g; and a fraction insoluble in boiling n-heptane in an amount of from 40 wt % to 85 wt %, preferably from 50 wt % to 80 wt %, having a melting enthalpy of greater than or equal to 45 J/g, preferably from 50 J/g to 95 J/g.

Further details concerning these materials and their use in cables covering are given in International Patent Application WO 01/37289 in the name of the Applicant.

The heterophase copolymers of class ($a_2$) are obtained by sequential copolymerization of: i) propylene, possibly containing minor quantities of at least one olefin comonomer selected from ethylene and an α-olefin other than propylene; and then of: ii) a mixture of ethylene with an α-olefin, in particular propylene, and possibly with minor portions of a diene.

Particularly preferred of said class ($a_2$) is a heterophase copolymer in which the elastomeric phase consists of an elastomeric copolymer of ethylene and propylene comprising from 15 wt % to 50 wt % of ethylene and from 50 wt % to 85 wt % of propylene with respect to the weight of the elastomeric phase. Further details concerning these materials and their use in cables covering are given in International Patent Application WO 00/41187 in the name of the Applicant.

Products of class ($a_1$) are available commercially for example under the trademark Rexflex® WL 105 of Huntsman Polymer Corporation or Borsoft® SA 233 CF of Borealis.

Products of class ($a_2$) are available commercially for example under the trademark Hifax® CA 10 A, Moplen® EP 310 G, or Adflex® Q 200 F of Basell.

According to one preferred embodiment, the elastomeric copolymer of ethylene (c) has a melting enthalpy of less than 30 J/g. The quantity of said elastomeric copolymer (c) is generally less than 70% by weight, preferably of from 20% by weight to 60% by weight, with respect to the total weight of the thermoplastic base material.

With reference to the elastomeric copolymer of ethylene (c), the term "aliphatic α-olefin" generally means an olefin of formula $CH_2{=}CH{-}R$, in which R represents a linear or branched alkyl group containing from 1 to 12 carbon atoms. Preferably, the aliphatic α-olefin is selected from propylene, 1-butene, isobutylene, 1-pentene, 4-methyl-1-pentene, 1-hexene, 1-octene, 1-dodecene, or mixtures thereof. Propylene, 1-hexene and 1-octene are particularly preferred.

With reference to the elastomeric copolymer of ethylene (c), the term "polyene" generally means a conjugated or non-conjugated diene, triene or tetraene. When a diene comonomer is present, this comonomer generally contains from 4 to 20 carbon atoms and is preferably selected from: linear conjugated or non-conjugated diolefins such as, for example, 1,3-butadiene, 1,4-hexadiene, 1,6-octadiene, and the like; monocyclic or polycyclic dienes such as, for example, 1,4-cyclohexadiene, 5-ethylidene-2-norbornene, 5-methylene-2-norbornene, vinylnorbornene, or mixtures thereof. When a triene or tetraene comonomer is present, this comonomer generally contains from 9 to 30 carbon atoms and is preferably selected from trienes or tetraenes containing a vinyl group in the molecule or a 5-norbornen-2-yl group in the molecule. Specific examples of triene or tetraene comonomers which may be used in the present invention are: 6,10-dimethyl-1,5,9-undecatriene, 5,9-dimethyl-1,4,8-decatriene, 6,9-dimethyl-1,5,8-decatriene, 6,8,9-trimethyl-1,6,8-decatriene, 6,10,14-trimethyl-1,5,9,13-pentadecatetraene, or mixtures thereof. Preferably, the polyene is a diene.

Particularly preferred elastomeric copolymers of ethylene (c) are:

($c_l$) copolymers having the following monomer composition: 35 mol %–90 mol % of ethylene; 10 mol %–65 mol % of an aliphatic α-olefin, preferably propylene; 0 mol %–10 mol % of a polyene, preferably a diene, more preferably, 1,4-hexadiene or 5-ethylene-2-norbornene (EPR and EPDM rubbers belong to this class);

($c_2$) copolymers having the following monomer composition: 75 mol %–97 mol %, preferably 90 mol %–95 mol %, of ethylene; 3 mol %–25 mol %, preferably 5 mol %–10 mol %, of an aliphatic α-olefin; 0 mol %–5 mol %, preferably 0 mol %–2 mol %, of a polyene, preferably a diene (for example ethylene/1-octene copolymers, such as the products Engage® of DuPont-Dow Elastomers).

According to a preferred embodiment, the dielectric liquid has an amount of polar compounds of between 0.1 and 2.3.

According to a further preferred embodiment, the dielectric liquid has a melting point or a pour point of between −130° C. and +80° C.

According to a further preferred embodiment, the dielectric liquid has a ratio of number of aromatic carbon atoms with respect to the total number of carbon atoms of between 0.01 and 0.4.

According to a further preferred embodiment, the dielectric liquid preferably has a dielectric constant, at 25° C., of less than or equal to 3.5 and preferably less than 3 (measured in accordance with IEC 247).

According to a further preferred embodiment, the dielectric liquid has a predetermined viscosity in order to prevent fast diffusion of the liquid within the insulating layer and hence its outward migration, as well as to enable the dielectric liquid to be easily fed and mixed into the thermoplastic polymer material. Generally, the dielectric liquid of the invention has a viscosity, at 40° C., of between 10 cst and 800 cSt, preferably between 20 cst and 500 cSt (measured according to ASTM standard D445-03).

According to one preferred embodiment, the dielectric liquid may be selected from: mineral oils such as, for example, naphthenic oils, aromatic oils, paraffinic oils, polyaromatic oils, said mineral oils optionally containing at least one heteroatom selected from oxygen, nitrogen or sulphur; liquid paraffins; vegetable oils such as, for example, soybean oil, linseed oil, castor oil; oligomeric aromatic polyolefins; paraffinic waxes such as, for example, polyethylene waxes, polypropylene waxes; synthetic oils such as, for example, silicone oils, alkyl benzenes (such as, for example, dodecylbenzene, di(octylbenzyl)toluene), aliphatic esters (such as, for example, tetraesters of pentaerythritol, esters of sebacic acid, phthalic esters), olefin oligomers (such as, for example, optionally hydrogenated polybutenes or polyisobutenes); or mixtures thereof. Paraffinic oils and naphthenic oils are particularly preferred.

The dielectric liquid suitable for implementing the invention has good heat resistance, considerable gas absorption capacity, in particular hydrogen absorption, and high resistance to partial discharges, so that dielectric losses are limited even at high temperature and high electrical gradient. The weight ratio of dielectric liquid to thermoplastic polymer material of the present invention is generally between 1:99 and 25:75, preferably between 2:98 and 20:80, and more preferably between 3:97 and 10:90.

According to one preferred embodiment, the cable of the invention has at least one extruded covering layer with electrical insulation properties formed from the thermoplastic polymer material in admixture with the aforedescribed dielectric liquid.

According to a further preferred embodiment, the cable of the invention has at least one extruded covering layer with semiconductive properties formed from the thermoplastic polymer material in admixture with the aforedescribed dielectric liquid. To form a semiconductive layer, a conductive filler is generally added to the polymer material. To ensure good dispersion of the conductive filler within the thermoplastic polymer material, the latter is preferably selected from propylene homopolymers or copolymers comprising at least 40 wt % of amorphous phase, with respect to the total polymer weight.

According to a further aspect, the present invention relates to a polymer composition comprising a thermoplastic polymer material in admixture with a dielectric liquid, wherein:

said thermoplastic polymer material is selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of from 20 J/g to 100 J/g;

(b) a mechanical mixture comprising at least one propylene homopolymer or copolymer (a) and (c) at least one elastomeric copolymer of ethylene with at least one aliphatic α-olefin, and optionally a polyene;

the concentration by weight of said dielectric liquid in said thermoplastic polymer material is lower than the saturation concentration of said dielectric liquid in said thermoplastic polymer material;

said dielectric liquid has the following characteristics:

an amount of polar compounds lower than or equal to 2.5% by weight with respect to the total weight of the dielectric liquid;

a melting point or a pour point lower than 80° C.;

a ratio of number of aromatic carbon atoms with respect to the total number of carbon atoms lower than 0.6, when the dielectric liquid is aromatic.

According to a further aspect, the present invention relates to the use of a polymer composition, as described hereinabove, as the polymer base material for preparing a cable covering layer with electrical insulation properties, or for preparing a cable covering layer with semiconductive properties.

In forming a covering layer for the cable of the invention, other conventional components may be added to the aforedefined polymer composition, such as antioxidants, processing aids, water tree retardants, or mixtures thereof.

Conventional antioxidants suitable for the purpose are for example distearyl- or dilauryl-thiopropionate and pentaerythrityl-tetrakis [3-(3,5-di-t-butyl-4-hydroxyphenyl)propionate], or mixtures thereof.

Processing aids which may be added to the polymer composition include, for example, calcium stearate, zinc stearate, stearic acid, or mixtures thereof.

With particular reference to medium and high voltage cables, the polymer materials as defined hereinabove may be advantageously used to obtain an insulating layer. As stated above, these polymer base materials show indeed good mechanical characteristics both at ambient temperature and under hot conditions, and also show improved electrical properties. In particular they enable high operating temperature to be reached, comparable with or even exceeding that of cables with coverings consisting of crosslinked polymer base materials.

If a semiconductive layer has to be formed, a conductive filler, in particular carbon black, is generally dispersed within the polymer base material in a quantity such as to provide the material with semiconductive characteristics (i.e. such as to obtain a resistivity of less than 5 Ohm*m at ambient temperature). This quantity is generally between 5 wt % and 80 wt %, and preferably between 10 wt % and 50 wt %, of the total weight of the mixture.

The use of the same polymer composition for both the insulating layer and the semiconductive layers is particularly advantageous in producing cables for medium or high voltage, in that it ensures excellent adhesion between adjacent layers and hence a good electrical behaviour, particularly at the interface between the insulating layer and the inner semiconductive layer, where the electrical field and hence the risk of partial discharges are higher.

The polymer composition of the present invention may be prepared by mixing together the thermoplastic polymer material, the dielectric liquid and any other additives possibly present by using methods known in the art. Mixing may be carried out for example by an internal mixer of the type with tangential rotors (Banbury) or with interpenetrating rotors, or, preferably, in a continuous mixer of Ko-Kneader (Buss) type, or of co- or counter-rotating double-screw type.

Alternatively, the dielectric liquid of the present invention may be added to the thermoplastic polymer material during the extrusion step by direct injection into the extruder cylinder as disclosed, for example, in International Patent Application WO02/47092 in the name of the Applicant.

According to the present invention, the use of the aforedefined polymer composition in cable covering layers for medium or high voltage enables recyclable, flexible coverings to be obtained with excellent mechanical and electrical properties.

Greater compatibility has also been found between the dielectric liquid and the thermoplastic polymer material of the present invention than in the case of similar mixtures of the same polymer material with other dielectric liquids known in the art. This greater compatibility leads, inter alia, to less exudation of the dielectric liquid. Due to their high operating temperature and their low dielectric losses, the cables of the invention can carry, for the same voltage, a power at least equal to or even greater than that transportable by a traditional cable with XLPE covering.

For the purposes of the invention the term "medium voltage" generally means a voltage of between 1 kV and 35 kV, whereas "high voltage" means voltages higher than 35 kV.

Although this description is mainly focused on the production of cables for transporting or distributing medium or high voltage energy, the polymer composition of the invention may be used for covering electrical devices in general and in particular cables of different type, for example low voltage cables, telecommunications cables or combined energy/telecommunications cables, or accessories used in electrical lines, such as terminals, joints or connectors.

BRIEF DESCRIPTION OF THE DRAWING

Further characteristics will be apparent from the detailed description given hereinafter with reference to the accompanying drawing, in which.

DETAILED DESCRIPTION OF THE INVENTION

Figure 1:
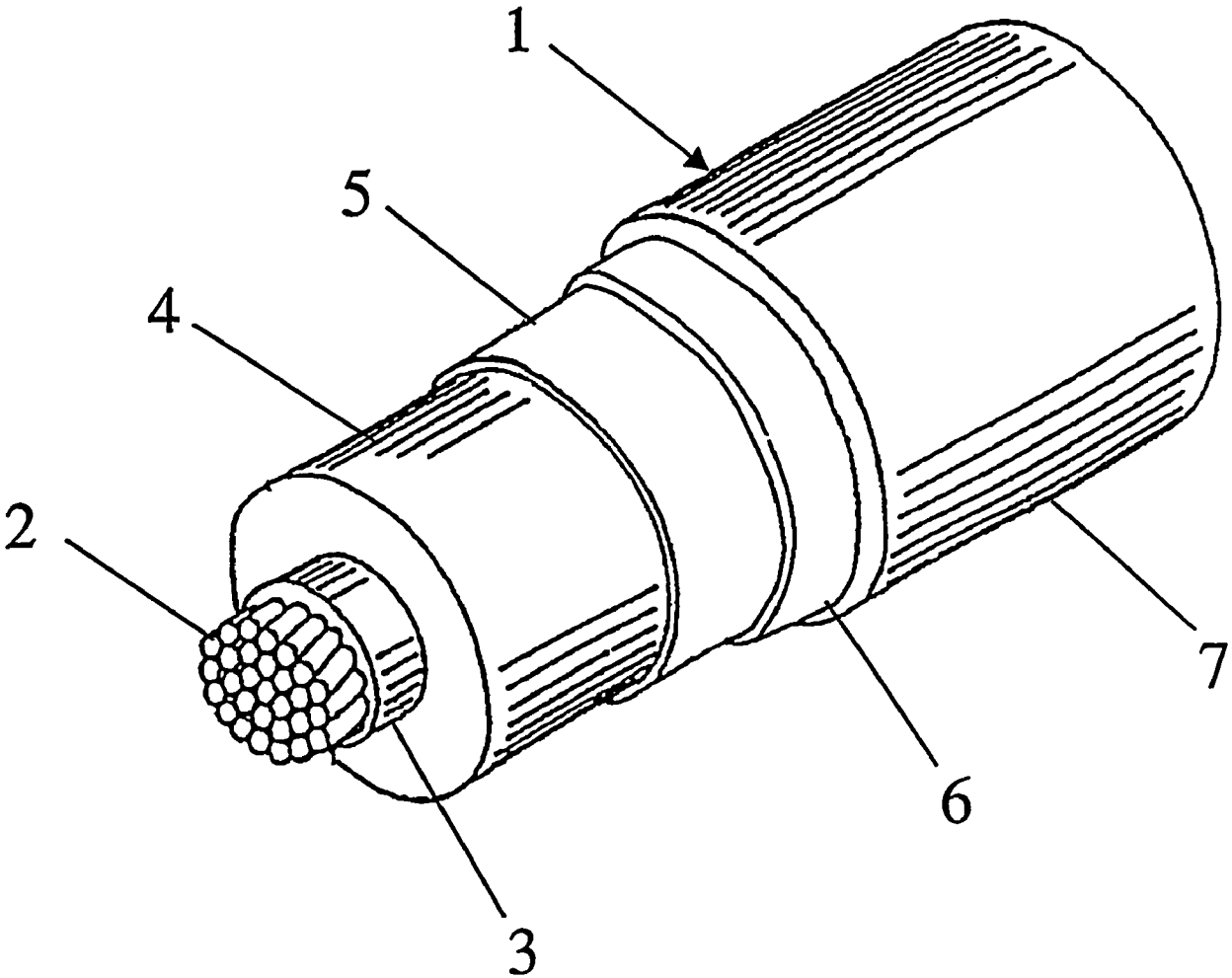
FIG. 1 is a perspective view of an electric cable, particularly suitable for medium or high voltage, according to the invention.

In FIG. 1, the cable (1) comprises a conductor (2), an inner layer with semiconductive properties (3), an intermediate layer with insulating properties (4), an outer layer with semiconductive properties (5), a metal screen (6), and an outer sheath (7).

The conductor (2) generally consists of metal wires, preferably of copper or aluminium, stranded together by conventional methods, or of a solid aluminium or copper rod. At least one covering layer selected from the insulating layer (4) and the semiconductive layers (3) and (5) comprises the composition of the invention as heretofore defined. Around the outer semiconductive layer (5) there is usually positioned a screen (6), generally of electrically conducting wires or strips wound helically. This screen is then covered by a sheath (7) of a thermoplastic material such as, for example, non-crosslinked polyethylene (PE).

The cable can be also provided with a protective structure (not shown in FIG. 1) the main purpose of which is to mechanically protect the cable against impacts or compressions. This protective structure may be, for example, a metal reinforcement or a layer of expanded polymer as described in WO 98/52197 in the name of the Applicant.

FIG. 1 shows only one possible embodiment of a cable according to the invention. Suitable modifications known in the art can be made to this embodiment, but without departing from the scope of the invention.

The cable covering layer or layers of thermoplastic material according to the present invention may be manufactured in accordance with known methods, for example by extrusion. The extrusion is advantageously carried out in a single pass, for example by the tandem method in which individual extruders are arranged in series, or by co-extrusion with a multiple extrusion head.

The following examples illustrate the invention, but without limiting it.

EXAMPLES 1–5

Compositions Preparation

The following components were used:

- a propylene heterophase copolymer with melting point 165° C., melting enthalpy 30 J/g, MFI 0.8 dg/min and flexural modulus 150 MPa (Adflex® Q 200 F—commercial product of Basell);
- a propylene heterophase copolymer with melting point 142° C., melting enthalpy 25 J/g, MFI 0.6 dg/min and flexural modulus of 85 MPa (Hifax® CA 10A—commercial product of Basell);
- Sunpar® 2280 (commercial product of Sunoco): paraffinic oil with viscosity of 475 cSt at 40° C., pour point of −15° C. and ratio of number of aromatic carbon atoms with respect to the total number of carbon atoms of 0.02, consisting of 69% wt paraffinic carbon atoms, 29 wt % naphthenic carbon atoms, 2 wt % aromatic carbon atoms and 1.5 wt % polar compounds;
- Nyflex®820 (commercial product of Nynas): naphthenic oil with viscosity of 110 cSt at 40° C., pour point of −27° C. and ratio of number of aromatic carbon atoms with respect to the total number of carbon atoms of 0.1, consisting of 10% wt aromatic carbon atoms, 46 wt % naphthenic carbon atoms, 44 wt % paraffinic carbon atoms and 0.2 wt % polar compounds;
- Nytex® 840 (commercial product of Nynas): naphthenic oil with with viscosity of 370 cSt at 40° C., pour point of −12° C. and ratio of number of aromatic carbon atoms with respect to the total number of carbon atoms of 0.15, consisting of 15% wt aromatic carbon atoms, 34 wt % naphthenic carbon atoms, 51 wt % paraffinic carbon atoms and 2.3 wt % polar compounds.

The polymer in granular form was preheated, under agitation, at 80° C., over 15 min, in a turbomixer. Subsequently, the dielectric liquid, 6% by weight, was added to the preheated polymer. After the addition, agitation was continued for 2 hours at 80° C. until the liquid was completely absorbed in the polymer granules.

After this first stage, the resultant material was kneaded in a laboratory double-screw Brabender Plasticorder PL2000 at a temperature of 180° C. to complete homogenization. The resultant material left the double-screw mixer in the form of granules.

Measurement of Dielectric Losses

Plates of 0.5 mm thickness were formed from the material obtained as disclosed above. The plates were moulded at 195° C. with 15 min preheating.

The plates obtained in this manner were subjected to dielectric loss measurement by measuring the tangent of the loss angle (tandelta) (according to ASTM standard D150-98) at differents temperatures (28° C. and 90° C.). The obtained results are given in Table 2.

Measurement of Flexural Modulus

The flexural modulus was determined on plates 60 mm×10 mm×1.5 mm obtained as disclosed above in accordance with ASTM standard D790-03: the obtained results are given in Table 1.

Measurement of Melting Point ($T_m$) and Melting Enthalpy (ΔH)

The melting point (Tm) and the melting enthalpy (ΔH) were determined by Differential Scanning Calorimetry (DSC) analysis by using a Mettler Toledo DSC 820 differential scanning calorimeter. The temperature program below was applied to the sample to be analysed:

cooling from room temperature to −100° C.;
heating from −100° C. to 200° C. at a rate of 10° C./min.;
isotherm for 5 minutes at 200° C.;
cooling to −100° C. at a rate of 2° C./min.;
isotherm for 10 minutes at −100° C.;
heating to 200° C. at a rate of 10° C./min.

The obtained results are given in Table 1.

TABLE 1

| EXAMPLE | Flexural modulus (MPa) | Melting point ($T_m$) (° C.) | Melting enthalpy (ΔH) (J/g) |
|---|---|---|---|
| 1 | 37 | 162 | 40.2 |
| 2 | 35 | 163 | 40.9 |
| 3 | 30 | 160 | 41.1 |
| 4 | 60 | 139 | 30.7 |
| 5 | 60 | 140 | 32.0 |

TABLE 2

| EXAMPLE | Gradient (G) (kV/mm) | Tandelta × $10^{-4}$ (28° C.) | Tandelta × $10^{-4}$ (90° C.) |
|---|---|---|---|
| 1 | 1.0 | 3.7 | 5.7 |
| 2 | 1.0 | 3.8 | 5.4 |
| 3 | 1.0 | 4.0 | 4.2 |
| 4 | 1.0 | 3.9 | 5.9 |
| 5 | 1.0 | 4.4 | 5.1 |

Example 1

94% by weight Adflex® Q 200 F+6% by weight Sunpar® 2280;

Example 2

94% by weight Adflex® Q 200 F+6% by weight Nyflex® 820;

Example 3

94% by weight Adflex® Q 200 F+6% by weight Nytex® 840;

Example 4

94% by weight Hifax® CA 10 A+6% by weight Sunpar® 2280;

Example 5

94% by weight Hifax® CA 10 A+6% by weight Nytex® 840.

EXAMPLE 6

Measurement of the Saturation Concentration

In order to determine the saturation concentration of the dielectric liquid in the thermoplastic materials, a plurality of plates were manufactured starting from the raw materials in pellets.

Two plates (200 mm×200 mm×0.5 mm) were obtained by molding the raw material (Adflex® Q 200 F) at 190° C. Five smaller Dumbell samples were obtained from each of the above plates and weighted ($W_0$).

The Dumbell samples were then totally immersed at 20° C., into a dielectric liquid: Sunpar® 2280 and Nyflex® 820, respectively. The saturation concentration was measured by determining the weight change (in percentage) of the plates after different times. The Dumbell samples were removed from the dielectric liquid after 3, 6, 9, 12 and 15 days, and after having cleaned their surface with a dry and clean cloth, they were weighted ($W_i$).

The dielectric liquid absorption was determined by the following formula:

$$\%\text{ of absorbed dielectric liquid}=[(W_i-W_0)/W_i]\times 100.$$

The saturation concentration is reached when $W_i$ shows a variation lower than 1% with respect to the total weight increase which correspond to ($W_i-W_0$).

The obtained results were the following:

the saturation concentration of Sunpar® 2280 in the Adflex® Q 200 F is 25% by weight;
the saturation concentration of Nyflex® 820 in the Adflex® Q 200 F is 46% by weight.

EXAMPLE 7

In order to verify the absence of two phases, e.g. the absence of a continues phase of a thermoplastic material and of an additional phase incorporated therein of a dielectric liquid, samples of the dielectric liquid as such and of thermoplastic material additioned with the dielectric liquid were subjected to the Modulated Differential Scanning Calorimetry (MDSC) analysis using a TA Instrument DSC 2920 Modulated differential scanning calorimeter.

10 mg of each sample were subjected to the following temperature program:

equilibrating at −145° C.;
modulating ±0.48° C. every 60 seconds;
keeping at −145° C. for 5 minutes;

heating to 200° C. at a rate of 5° C./min;

keeping at 200° C. for 2 minutes.

The obtained results are given in Table 3.

TABLE 3

| EXAMPLE | MDSC ANALYSIS |
|---|---|
| Sunpar ® 2280 | −0.59° C. |
| Adflex ® Q 200 F. + 6% Sunpar ® 2280 | absent |
| Adflex ® Q 200 F. + 34% Sunpar ® 2280 | −0.59° C. |

The results in Table 3 show that:

in the case the dielectric liquid as such, a peak at −0.59° C. was present;

in the case the dielectric liquid is added to the thermoplastic material in a quantity (6% by weight) lower than its saturation concentration in said thermoplastic material, the peak at −0.59° C., characteristic of the dielectric liquid as such, was not present, showing that the dielectric liquid was microscopically homogeneously dispersed in the thermoplastic material;

in the case the dielectric liquid is added to the thermoplastic material in a quantity (25% by weight) equal to its saturation concentration in said thermoplastic material, the peak at −0.59° C., characteristic of the dielectric liquid as such, was present, showing that the dielectric liquid was not microscopically homogeneously dispersed in the thermoplastic material.

EXAMPLES 8–9 (COMPARATIVE)

Compositions Preparation

The following components were used:

a propylene heterophase copolymer with melting point of 142° C., melting enthalpy 25 J/g, melting point 142° C., MFI 0.6 dg/min and flexural modulus of 85 MPa (Hifax® CA 10A—commercial product of Basell);

Nytex® 800 (commercial product of Nynas): naphthenic oil with viscosity of 7.3 cSt at 40° C., pour point of −60° C. and ratio of number of aromatic carbon atoms with respect to the total number of carbon atoms of 0.07, consisting of 7 wt % aromatic carbon atoms, 53 wt % naphthenic carbon atoms, 40 wt % of paraffinic carbon atoms and 0.5 wt % polar compounds;

Indopol® L-100 (commercial product of BP Amoco): polybutene oil with viscosity of 210 cSt at 40° C., pour point of −30° C. and 0.5 wt % polar compounds.

The polymer in granular form was preheated, under agitation, at 80° C., over 15 min, in a turbomixer. Subsequently, the dielectric liquid, 40% by weight, was added to the preheated polymer. After the addition agitation was continued for 2 hours at 80° C. until the liquid was completely absorbed in the polymer granules.

After this first stage, the resultant material was kneaded in a laboratory double-screw Brabender Plasticorder PL2000 at a temperature of 150° C. to complete homogenization. The resultant material left the double-screw mixer in the form of granules.

The flexural modulus, the melting point ($T_m$), the melting enthalpy (ΔH) and the dielectric losses were measured as disclosed above: the obtained results were given in Table 4 and in Table 5.

TABLE 4

| EXAMPLE | Flexural modulus (MPa) | Melting point ($T_m$) (° C.) | Melting enthalpy (ΔH) (J/g) |
|---|---|---|---|
| 8 | 9.1 | 126 | 18.3 |
| 9 | 6.6 | 133 | 17.8 |

TABLE 5

| EXAMPLE | Gradient (G) (kV/mm) | Tandelta × $10^{-4}$ (28° C.) | Tandelta × $10^{-4}$ (90° C.) |
|---|---|---|---|
| 8 | 1 | 8.9 | 6.1 |
| 9 | 1 | 3.3 | 4.6 |

Example 8

60% by weight Hifax® CA 10 A+40% by weight of Nytex® 800;

Example 9

60% by weight Hifax® CA 10 A+40% by weight of Indopol® L-100.

The saturation concentration of Nytex® 800 in Hifax® CA 10 A (Example 8) was determined as disclosed above and corresponds to 40% by weight.

The material of Example 8 was subjected to Modulated Differential Scanning Calorimetry (MDSC) analysis operating as disclosed above: a peak at −93° C., characteristic of the dielectric liquid as such (namely Nytex® 800), was present, showing that the dielectric liquid was not microscopically homogeneously dispersed in the thermoplastic material.

EXAMPLE 10

Scanning Electron Microscopy (SEM)

Scanning Electron Microscopy (SEM) analysis was conducted as follows by utilizing the compositions of Examples 1–5 (according to the present invention) and the compositions of Examples 8–9 (comparative). Compression molded tensile samples were notched with a razor blade and subsequently immersed in liquid nitrogen. Samples were then fractured in a compact tension mode. Freeze-fracture morphology of gold coated samples was examined with a Hitachi S-400 SEM operating at 10 KV. Digital image analysis was performed on a series of micrographs to determine the presence of a single-phase material or of a two-phases material. At 5000× the surfaces of the samples obtained from the compositions of Examples 1–5 (according to the present invention) were homogeneous and devoid of cavity showing that the material is a single phase material. On the contrary, at 5000×, the surfaces of the samples obtained from the compositions of Example 8 and 9 (comparative), were not homogeneous and presented a lot of cavity showing that the material is a two phase material. Moreover, the samples obtained from Examples 8–9, showed exudation of the dielectric liquid at room temperature.

EXAMPLE 11

Cable Production

The compositions of the insulating layer and of the semiconductive layers are described in Table 6 below.

TABLE 6

| | Cable according to the present invention | | Comparison cable | |
|---|---|---|---|---|
| | Inner and outer semicond. layers (%) by weight | Insulation layer (%) by weight | Inner and outer semicond. layers (%) by weight | Insulation layer (%) by weight |
| Adflex ® Q 200 F. | 60.4 | 93.4 | 66.4 | 99.4 |
| Ensaco ® 250 G | 33 | — | 33 | — |
| Sunpar ® 2280 | 6 | 6 | — | — |
| Irganox ® PS 802 | 0.4 | 0.4 | 0.4 | 0.4 |
| Irganox ® 1010 | 0.2 | 0.2 | 0.2 | 0.2 |

Ensaco ® 250 G: carbon black with specific surface of 65 $m^2/g$ (commercial product of MMM Carbon);
Irganox ® PS 802 (antioxidant): distearyl thiodipropionate (commercial product of Ciba Specialty Chemicals);
Irganox ® 1010 (antioxidant): pentaerithrityl-tetrakis-(3-(3,5-di-t-butyl-4-hydroxy-phenyl)-propionate (commercial product of Ciba Specialty Chemicals).

The process used for manufacturing the cable was the following.

The Adflex® Q 200 F was fed directly into the extruder hopper. Subsequently, the Sunpar® 2280 previously mixed with the antioxidants, was injected at high pressure into the extruder. An extruder having a diameter of 80 mm and an L/D ratio of 25 was used. The injection was made during the extrusion at about 20 D from the beginning of the extrduder screw by means of three injections point on the same cross-section at 120° from each other. The dielectric liquid was injected at a temperature of 70° C. and a pressure of 250 bar.

The cable leaving the extrusion head was cooled to ambient temperature by passing it through cold water.

The finished cable consisted of an aluminum conductor (cross-section 150 $mm^2$), an inner semiconductive layer of about 0.5 mm in thickness, an insulating layer of about 4.5 mm in thickness and finally an outer semiconductive layer of about 0.5 mm in thickness.

Under similar conditions, by using the materials indicated in Table 2, a comparison cable was produced without adding the dielectric liquid.

Dielectric Strength

Three pieces (each being 20 metres in length) of the two cables produced as described above were subjected to dielectric strength measurement using alternating current at ambient temperature. Starting from 100 kV the gradient applied to the cables was increased by 10 kV every 10 minutes until the cables broke down. The break down gradient considered is that on the conductor.

Table 7 summarizes the results of the electrical tests: the data represent the average value obtained from three different measurements.

TABLE 7

| | Cable according to the present invention (kV/mm) | Comparison cable (kV/mm) |
|---|---|---|
| AC break down | 59 | 29 |

EXAMPLE 12 (COMPARISON)

Cable Production

The compositions of the insulation layer is described in Table 8 below.

TABLE 8

| | COMPOSITION OF THE INSULATION LAYER (%) by weight |
|---|---|
| Adflex ® Q 200 F. | 79.4 |
| Sunpar ® 2280 | 25 |
| Irganox ® PS 802 | 0.4 |
| Irganox ® 1010 | 0.2 |

The process used for manufacturing the cable was the following.

The Adflex® Q 200 F was fed directly into the extruder hopper. An extruder having a diameter of 80 mm and an L/D ratio of 25 was used. Subsequently, an attempt was made to inject the Sunpar® 2280 previously mixed with the antioxidants into the extruder. The injection was impossible to be carried out since the dielectric liquid exit the extruder die. Consequently, the production of a finished cable was impossible to be carried out.

The invention claimed is:

1. A cable comprising:

at least one electrical conductor; and at least one extruded covering layer based on a thermoplastic polymer material in admixture with a dielectric liquid, wherein the thermoplastic polymer material is selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of from 20 J/g to 100 J/g; or (b) a mechanical mixture comprising at least one propylene homopolymer or copolymer (a) and (c) at least one elastomeric copolymer of ethylene with at least one aliphatic α-olefin, and optionally a polyene;

the concentration by weight of said dielectric liquid in the thermoplastic polymer material is lower than the saturation concentration of said dielectric liquid in the thermoplastic polymer material; and said dielectric liquid has the following characteristics:

an amount of polar compound lower than or equal to 2.5% by weight with respect to the total weight of the dielectric liquid;

a melting point or a pour point lower than 80° C.; and a ratio of number of aromatic carbon atoms with respect to the total number of carbon atoms lower than 0.6, when the dielectric liquid is aromatic.

2. The cable according to claim 1, wherein the propylene homopolymer or copolymer (a) has a melting point of 140° C. to 170° C.

3. The cable according to claim 1, wherein the propylene homopolymer or copolymer (a) has a melting enthalpy of 30 J/g to 85 J/g.

4. The cable according to claim 1, wherein the propylene homopolymer or copolymer (a) has a flexural modulus, measured according to ASTM standard D790, at room temperature, of 30 MPa to 1400 MPa.

5. The cable according to claim 4, wherein the propylene homopolymer or copolymer (a) has a flexural modulus, measured according to ASTM standard D790, at room temperature, of 60 MPa to 1000 MPa.

6. The cable according to claim 1, wherein the propylene homopolymer or copolymer (a) has a melt flow index (MFI), measured at 230° C. with a load of 21.6 N according to ASTM standard D1238/L, of 0.05 dg/min to 10.0 dg/min.

7. The cable according to claim 6, wherein the propylene homopolymer or copolymer (a) has a melt flow index (MFI), measured at 230° C. with a load of 21.6 N according to ASTM standard D1238/L, of 0.4 dg/min to 5.0 dg/min.

8. The cable according to claim 1, wherein in the propylene copolymer (a) the olefin comonomer is present in a quantity of less than or equal to 15 mol %.

9. The cable according to claim 8, wherein in the propylene copolymer (a) the olefin comonomer is present in a quantity of less than or equal to 10 mol %.

10. The cable according to claim 1, wherein in the propylene copolymer (a) the olefin comonomer is ethylene or an α-olefin of formula $CH_2{=}CH{-}R$, where R is a linear or branched $C_2$–$C_{10}$ alkyl.

11. The cable according to claim 10, wherein the α-olefin is selected from: 1-butene, 1-pentene, 4-methyl-1-pentene, 1-hexene, 1-octene, 1-decene, 1-dodecene, or mixtures thereof.

12. The cable according to claim 1, wherein the propylene homopolymer or copolymer (a) is selected from:

($a_1$) a propylene homopolymer or a copolymer of propylene with at least one olefin comonomer selected from ethylene and an α-olefin other than propylene, having a flexural modulus generally of 30 MPa to 900 MPa; or ($a_2$) a heterophase copolymer comprising a thermoplastic phase based on propylene and an elastomeric phase based on ethylene copolymerized with an α-olefin.

13. The cable according to claim 12, wherein the propylene homopolymer or copolymer of ($a_1$) has a melting point of 140° C. to 170° C.

14. The cable according to claim 12, wherein the propylene homopolymer or copolymer of ($a_1$) has a melting enthalpy of 30 J/g to 80 J/g.

15. The cable according to claim 12, wherein the propylene homopolymer or copolymer of ($a_1$) has a fraction soluble in boiling diethyl ether in an amount of less than or equal to 12 wt %, having a melting enthalpy of less than or equal to 4 J/g.

16. The cable according to claim 12, wherein the propylene homopolymer or copolymer of ($a_1$) has a fraction soluble in boiling n-heptane in an amount of 15 wt % to 60 wt %, having a melting enthalpy of from 10 J/g to 40 J/g.

17. The cable according to claim 12, wherein the propylene homopolymer or copolymer of ($a_1$) has a fraction insoluble in boiling n-heptane in an amount of 40 wt % to 85 wt %, having a melting enthalpy of greater than or equal to 45 J/g.

18. The cable according to claim 12, wherein the α-olefin in the elastomeric phase of a heterophase copolymer of ($a_2$) is propylene.

19. The cable according to claim 12, wherein the heterophase copolymer of ($a_2$) is a heterophase copolymer in which the elastomeric phase consists of an elastomeric copolymer of ethylene and propylene comprising 15 wt % to 50 wt % of ethylene and 50 wt % to 85 wt % of propylene with respect to the weight of the elastomeric phase.

20. The cable according to claim 1, wherein the elastomeric copolymer of ethylene (c) has a melting enthalpy of less than 30 J/g.

21. The cable according to claim 1, wherein the quantity of the elastomeric copolymer (c) is less than 70% with respect to the total weight of the thermoplastic base material.

22. The cable according to claim 1 wherein the aliphatic α-olefin in the elastomeric copolymer of ethylene (c) is an olefin of formula $CH_2{=}CH{-}R$, in which R represents a linear or branched alkyl group containing from 1 to 12 carbon atoms.

23. The cable according to claim 22, wherein the aliphatic α-olefin is selected from propylene, 1-butene, isobutylene, 1-pentene, 4-methyl-1-pentene, 1-hexene, 1-octene, 1-dodecene, or mixtures thereof.

24. The cable according to claim 23, wherein the aliphatic α-olefin is selected from propylene, 1-hexene, and 1-octene.

25. The cable according to claim 1, wherein the polyene in the elastomeric copolymer of ethylene (c) is a conjugated or non-conjugated diene, triene or tetraene.

26. The cable according to claim 25, wherein the polyene is a diene.

27. The cable according to claim 1, wherein the elastomeric copolymer of ethylene (c) is selected from:

($c_1$) copolymers having the following monomer composition: 35 mol %–90 mol % of ethylene; 10 mol %–65 mol % of an aliphatic α-olefin; and 0 mol %–10 mol % of a polyene; and ($c_2$) copolymers having the following monomer composition: 75 mol %–97 mol % of ethylene; 3 mol %–25 mol % of an aliphatic α-olefin; and 0 mol %–5 mol % of a polyene.

28. The cable according to claim 1, wherein the dielectric liquid comprises an amount of polar compound between 0.1 wt % and 2.3 wt %.

29. The cable according to claim 1, wherein the dielectric liquid has a melting point or a pour point between −130° C. and +80° C.

30. The cable according to claim 1, wherein the dielectric liquid has a ratio of number of aromatic carbon atoms with respect to the total number of carbon atoms between 0.01 and 0.4.

31. The cable according to claim 1, wherein the dielectric liquid has a dielectric constant, at 25° C., less than or equal to 3.5 (measured in accordance with IEC 247).

32. The cable according to claim 1, wherein the dielectric liquid has a viscosity, at 40° C., between 10 cSt and 800 cSt (measured according to ASTM standard D445-03).

33. The cable according to claim 32, wherein the dielectric liquid has a viscosity, at 40° C., between 20 cSt and 500 cSt (measured according to ASTM standard D445-03).

34. The cable according to claim 1, wherein the dielectric liquid is selected from: mineral oils, naphthenic oils, aromatic oils, paraffinic oils, polyaromatic oils, mineral oils optionally containing at least one heteroatom selected from oxygen, nitrogen or sulphur; liquid paraffins; vegetable oils, soybean oil, linseed oil, castor oil; oligomeric aromatic polyolefins; paraffinic waxes, polyethylene waxes, polypropylene waxes; synthetic oils, silicone oils, alkyl benzenes, dodecylbenzene, di(octylbenzyl) toluene, aliphatic esters, tetraesters of pentaerythritol, esters of sebacic acid, phthalic acid esters, olefin oligomers, optionally hydrogenated polybutenes or polyisobutenes; or mixtures thereof.

35. The cable according to claim 34, wherein the dielectric liquid is selected from paraffinic oils and naphthenic oils.

36. The cable according to claim 1, wherein the weight ratio of dielectric liquid to thermoplastic polymer material is between 1:99 and 25:75.

37. The cable according to claim 36, wherein the weight ratio of dielectric liquid to thermoplastic polymer material is between 2:98 and 20:80.

38. The cable according to claim 37, wherein the weight ratio of dielectric liquid to thermoplastic polymer material is between 3:97 and 10:90.

39. The cable according to claim 1, wherein the thermoplastic polymer material is selected from propylene homopolymers or copolymers comprising at least 40 wt % of amorphous phase, with respect to the total polymer weight.

40. The cable according to claim 1, wherein the extruded covering layer based on said thermoplastic polymer material in admixture with said dielectric liquid is an electrically insulating layer.

41. The cable according to claim 1, wherein the extruded covering layer based on said thermoplastic polymer material in admixture with said dielectric liquid is a semiconductive layer.

42. A polymer composition comprising: a thermoplastic polymer material in admixture with a dielectric liquid, wherein:

said thermoplastic polymer material is selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of from 20 J/g to 100 J/g; and (b) a mechanical mixture comprising at least one propylene homopolymer or copolymer (a) and (c) at least one elastomeric copolymer of ethylene with at least one aliphatic α-olefin, and optionally a polyene;

the concentration by weight of said dielectric liquid in the thermoplastic polymer material is lower than the saturation concentration of said dielectric liquid in said thermoplastic polymer material; and said dielectric liquid has the following characteristics:

an amount of polar compound lower than or equal to 2.5% by weight with respect to the total weight of the dielectric liquid;

a melting point or a pour point lower than 80° C.; and a ratio of number of aromatic carbon atoms with respect to the total number of carbon atoms lower than 0.6, when the dielectric liquid is aromatic.

43. The polymer composition according to claim 42, wherein the propylene homopolymer or copolymer of propylene (a) has at least one of the properties: a flexural modulus, measured according to ASTM standard D790, at room temperature, from 30 MPa to 1400 MPa, or a melt flow index (MFI), measured at 230° C. with a load of 21.6 N according to ASTM standard D1238/L, from 0.05 dg/min to 10.0 dg/min.

44. The polymer composition according to claim 42, wherein the propylene homopolymer or copolymer (a) is selected from:

($a_1$) a propylene homopolymer or a copolymer of propylene with at least one olefin comonomer selected from ethylene and an α-olefin other than propylene, having a flexural modulus generally of from 30 MPa to 900 MPa; and ($a_2$) a heterophase copolymer comprising a thermoplastic phase based on propylene and an elastomeric phase based on ethylene copolymerized with an α-olefin.

45. The polymer composition according to claim 42, wherein the elastomeric copolymer of ethylene (c) is selected from:

($c_1$) copolymers having the following monomer composition: 35 mol %–90 mol % of ethylene; 10 mol %–65 mol % of an aliphatic α-olefin; and 0 mol %–10 mol % of a polyene; and ($c_2$) copolymers having the following monomer composition: 75 mol %–97 mol % of ethylene; 3 mol %–25 mol % of an aliphatic α-olefin; and 0 mol %–5 mol % of a polyene.

46. The polymer composition according to claim 42, wherein the dielectric liquid is selected from: mineral oils, naphthenic oils, aromatic oils, paraffinic oils, polyaromatic oils, mineral oils optionally containing at least one heteroatom selected from oxygen, nitrogen or sulphur; liquid paraffins; vegetable oils, soybean oil, linseed oil, castor oil; oligomeric aromatic polyolefins; paraffinic waxes, polyethylene waxes, polypropylene waxes; synthetic oils, silicone coils, alkyl benzenes dodecylbenzene, di(octylbenzyl) toluene, alphatic esters, tetraesters of pentaerythritol, esters of sebacic acid, phthalic acid esters, olefin oligomers, optionally hydrogenated polybutenes or polyisobutenes or mixtures thereof.

47. A cable covering layer comprising the polymer composition according to claim 42, wherein the thermoplastic polymer material in admixture with the dielectric liquid is electrically insulating.

48. A cable covering layer comprising the polymer composition according to claim 42, wherein the thermoplastic polymer material in admixture with the dielectric liquid is semiconductive.

* * * * *

UNITED STATES PATENT AND TRADEMARK OFFICE

CERTIFICATE OF CORRECTION

PATENT NO. : 7,196,270 B2
APPLICATION NO. : 10/542572
DATED : March 27, 2007
INVENTOR(S) : Perego et al.

It is certified that error appears in the above-identified patent and that said Letters Patent is hereby corrected as shown below:

Claim 46, column 20, line 42, "coils, alkyl benzenes dodecylbenzene," should read --oils, alkyl benzenes, dodecylbenzene,--.

Signed and Sealed this

Eighteenth Day of December, 2007

JON W. DUDAS
*Director of the United States Patent and Trademark Office*